United States Patent [19]

Gibbs

[11] 4,158,439

[45] Jun. 19, 1979

[54] CHIMNEY WASTE HEAT COLLECTOR REQUIRING NO BUILDING RENOVATION

[76] Inventor: John W. Gibbs, 568 West St., Lunenberg, Mass. 01462

[21] Appl. No.: 834,173

[22] Filed: Sep. 19, 1977

[51] Int. Cl.[2] ..... F24B 7/00

[52] U.S. Cl. ..... 237/55; 122/20 B; 165/DIG. 2

[58] Field of Search ..... 237/54, 55; 122/20 B; 165/DIG. 2, 169, 170; 126/400

[56] References Cited

U.S. PATENT DOCUMENTS

| | | | |
|---|---|---|---|
| 2,307,600 | 1/1943 | Munters et al. | 237/55 |
| 2,620,431 | 12/1952 | Shepheard | 122/20 B |
| 2,634,720 | 4/1953 | Thulman | 237/55 |
| 3,999,709 | 12/1976 | Estabrook | 165/DIG. 2 |
| 4,066,210 | 1/1978 | Pemberton | 122/20 B |

*Primary Examiner*—Robert A. Hafer
*Attorney, Agent, or Firm*—Pearson & Pearson

[57] ABSTRACT

A chimney, waste-heat, collector includes a plurality of elongated sections, coupled end-to-end and lowerable successively down a chimney. The collector comprises at least one vertical, up-flow, conduit and at least one down-flow conduit within the chimney forming a closed loop system with a pair of horizontal conduits extending out the ash pit opening to a heat storage and dissemination means. The couplings are threaded unions for ready assembly and the sections are preferably of right angular, or rectangular cross section and of thin wall stainless steel. A pump circulates liquid around the loop when the furnace is operated.

12 Claims, 6 Drawing Figures

Fig. 1.
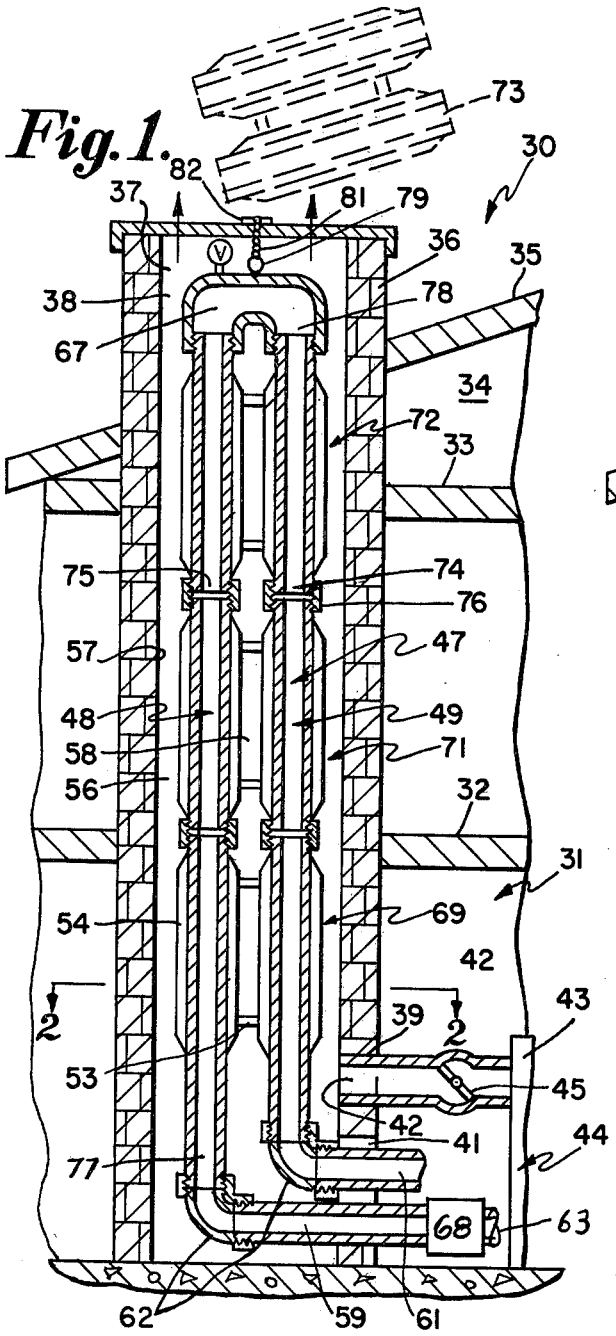
Fig. 3.
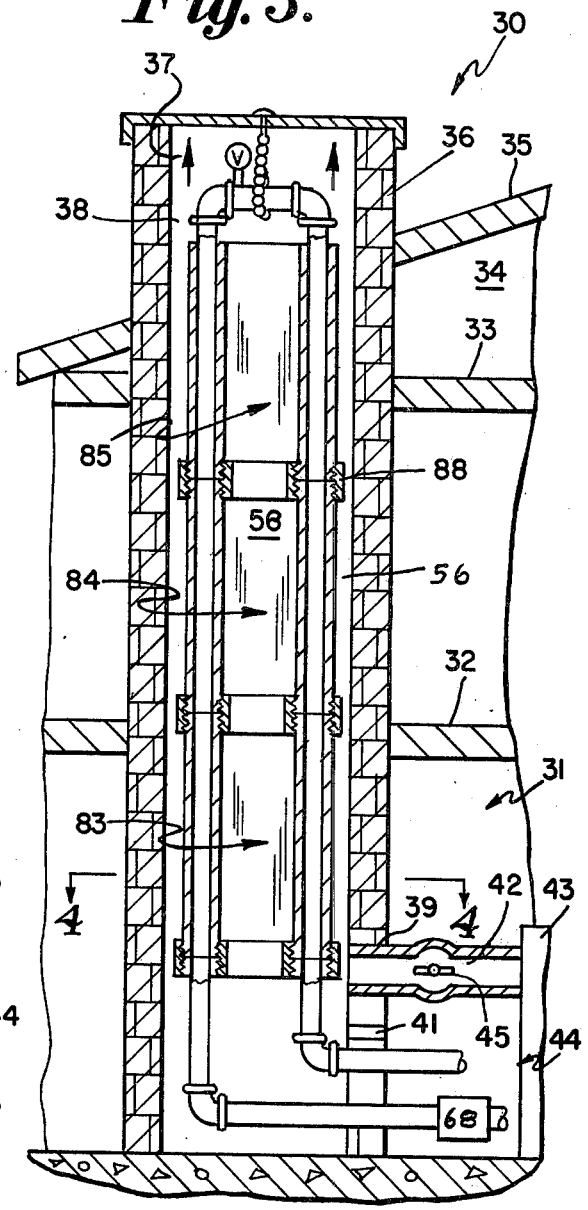
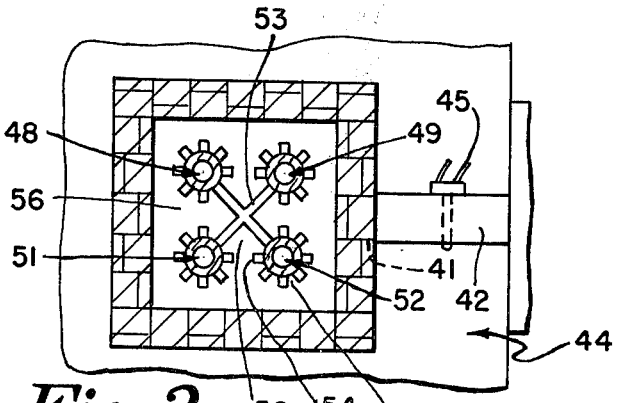
Fig. 2.
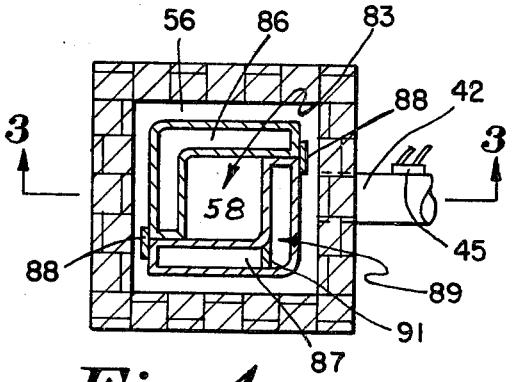
Fig. 4.

CHIMNEY WASTE HEAT COLLECTOR REQUIRING NO BUILDING RENOVATION

BACKGROUND OF THE INVENTION

Collection of waste heat passing upwardly in a metal stack, or in a brick chimney has long been proposed, but such structures do not appear to have come into general use.

In U.S. Pat. No. 866,842 to Comstock of Sept. 24, 1902 a metal stack is disclosed which extends from cellar to roof in a building and both the furnace and stack are provided with an exterior liquid jacket, the return pipes requiring holes in the floor.

In U.S. Pat. No. 2,307,600 to Munters of Jan. 5, 1943, a similar jacketed metal stack is disclosed extending from cellar to roof, with return pipes also requiring holes in the floors. The jacketed metal stack is in a plurality of sections coupled end to end and a built in superstructure is required to install and support the device.

It has also been proposed to incorporate a full length, or a sectional heat exchanger in an existing chimney of a building.

Exemplary of such systems in U.S. Pat. No. 2,524,843 to Slifer of Oct. 10, 1950, wherein the brick chimney encloses a central vertical smoke flue for the combustion gases, and surrounded by a pair of concentric air flues which feed heated air through holes in the walls into the building.

Also proposing such a system within a brick chimney is the circulator of U.S. Pat. No. 1,984,949 to Smith of Dec. 18, 1934, wherein the brick chimney also encloses a central vertical smoke flue for the combustion gases, encompassed by a fresh air passage which connects with holes in the walls of the building. The central smoke flue is in sections, connected end to end and is provided with horizontal fins. Like the Munters sectional metal stack of U.S. Pat. No. 2,307,600, which is built into the building, the Smith sectional stack is built into the inside of the chimney and supported on cross plates embedded in the brick work.

SUMMARY OF THIS INVENTION

In this invention, the heat exchanger collects waste heat from inside the existing brick chimney of a building without requiring any structural change therein by way of new holes in the brick work of the chimney or in the walls or floors of an existing building. It consists of a closed loop, liquid carrying system having an upflow conduit and a down flow conduit wholly within the chimney, and lowerable therein, in sections easily handled by one man from the roof and easily coupled end-to-end by threaded union couplings. Also included are horizontal extensions coupled to the lowermost section by way of the ash pit opening and extending out that opening to a water tank, solar heat rock storage tank or other heat storage and dissemination means.

The elongated sections may each be a cluster of longitudinally finned, thin walled conduits, of corrosion resistant material such as stainless steel, but preferably are of hollow rectangular or hollow right angular cross section, the latter type being nestable to accomodate chimneys of various areas of cross section.

Because no holes in the walls, floors, chimney, etc. are required there is no danger of combustion gas, carbon monoxide or the like leaking into the building and the sectional, union coupling assembly permits a do it yourself type installation within the means of the average householder. The cost of manufacture and installation is therefore sufficiently low to merit its purchase by a user as an energy conservation means.

BRIEF DESCRIPTION OF THE DRAWING

FIG. 1 is a side elevation in half section of a typical building, chimney and furnace with the closed, fluid-circulating heat exchanger of the invention operable within the brick chimney;

FIG. 2 is a top plan view in section on line 2—2 of FIG. 1;

FIG. 3 is a view similar to FIG. 1 of the preferred embodiment;

FIG. 4 is a top plan view in section on line 4—4 of FIG. 3;

DESCRIPTION OF THE PREFERRED EMBODIMENT

Figure 5:
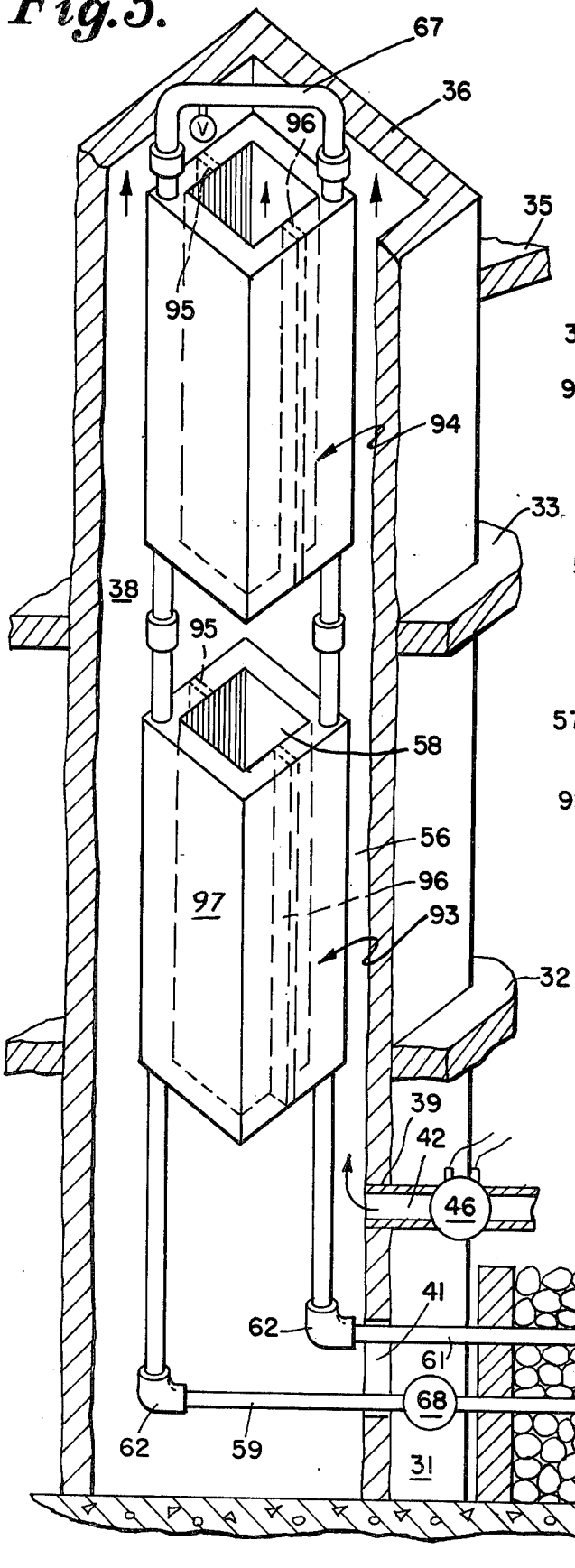
FIG. 5 is an enlarged fragmentary perspective view of a heat exchanger of the invention of annular, rectangular configuration.

A typical building such as a house 30 is shown in the drawings, the house 30 having a cellar 31, first floor 32, attic floor 33, attic 34, roof 35 and a chimney 36 of conventional brick 37 or similar fireproof material. The house 30 may have a second floor, or third floor, not shown, and the chimney 36 is preferably of the type having no fireplaces which would interfere with the lowering of heat exchanger sections individually and successively from the roof 35 through the top opening 37 down the interior 38 of the chimney to proximate the level of the smoke flue opening 39 and the ash pit door opening 41.

The smoke flue 42 connects the furnace 43 of the house heating system 44, to the interior 38 of the chimney 36 and includes the usual stack switch mechanisms 45 of conventional oil, gas or coal heating furnaces. As shown in FIG. 5 the smoke flue 42 preferably also includes a draft inducer in the form of a motorized blower 46, controlled automatically by the thermostat of the heating system to supplement the ordinary draft of the chimney because of the space occupied by the heat exchanger in the interior 38 of the chimney 36.

The elongated heat exchanger 47 of the invention comprises a closed loop, fluid circulating system including at least two vertical, fluid carrying conduits such as 48 and 49, extending along the interior 38 of the chimney 36 from proximate the level of the ash pit opening 41 to a predetermined distance below the level of the top opening 37 of the chimney. At least one such conduit is a downward return conduit and at least one other conduit is an upward flow conduit. As shown in FIGS. 1 and 2 there are three upward flow conduits 48, 51 and 52 and one downward flow, return conduit 49, all entirely within the chimney and all preferably formed of thin wall, corrosion-resistant sheet metal such as stainless steel or the equivalent.

The elongated fluid carrying conduits 48, 49, 51 and 52 are connected to each other by suitable spider structure 53 and each includes alternate, integral, longitudinally extending fins 54 and grooves 55 to absorb more heat without obstructing draft as would horizontal fins. A smoke or combustion gas, passage 56 is formed between the exteriors of the conduits and the inner wall 57 of the chimney and another smoke passage 58 is formed in the space between the conduits.

The heat exchanger 47 also includes at least two horizontal extensions 59 and 61 of the vertical conduits 48, 49, 51 or 52, which are connected thereto by removable, threaded unions, or couplings, 62, of known type and which extend out of the interior 38 of chimney 36 through the ash pit opening 41 to a heat storage and dissemination means 63 in the cellar 31 or elsewhere within the house 30.

As shown in FIG. 5, the heat storage and dissemination means 63 preferably includes a water tank 64 and the fluid in the heat exchanger is preferably water 65 with a suitable antifreeze liquid 66 in solution therein as used in automobile radiator heating systems. The heat exchanger 47 includes a manifold 67 at the top to connect the conduits 48, 49, 51 and 52 and form a closed loop, liquid-circulation system. The horizontal extension 59 includes an electric motor driven pump 68, controlled by the thermostat of heating system 44 so that when the furnace 43 is placed in operation and the hot gas and smoke passes up the chimney, the pump will circulate the liquid up the conduits and back again to the tank 64 to heat the water in the tank from waste heat in the chimney.

The heat exchanger 47 and its vertical conduits 48, 49, 51 and 52 are preferably formed in a plurality of substantially identical sections such as 69, 71 and 72, formed by a cluster of spider connected conduit sections of about six feet in length so that each section can be easily lifted to the roof 35, by one man, and lowered down the chimney as shown in dotted lines at 73 in FIG. 1.

Each section includes suitable threaded effluent nipples 74 and threaded influent nipples 75 together with threaded unions, or couplings, 76 so that the second section 71 can be sealingly, and detachably, connected to the first section 69, the third section 72 similarly connected until the bottom 77 of the lowermost section can be threadedly coupled to the horizontal sections 59 and 71 through the ash pit opening 41. The manifold 67 is threaded across the top 78 of the uppermost section and includes a central eye 79 by which the sectional exchanger may be suspended by a chain 81 from a cross bar 82 resting on the chimney top.

Each section 69, 71 or 72 thus comprises a cluster of spaced apart approximately six foot long conduits of thin wall, fluted sheet metal joined by a spider into a light, integral unit adapted to fit within a brick chimney of average, inside dimensions such as about eight inches by six inches. The stainless steel is about one eighth of an inch in thickness and the inside dimensions of the conduit sections is about three-eighths of an inch so that the conduits are thin enough to heat rapidly from upward moving waste heat.

It should be noted that the medium being heated, namely fluid inside the sheet metal conduits, cannot escape into the house through apertures in the chimney, if the metal conduit should corrode, or fracture, so that the device is not only easily installed with no structural renovation required but it is wholly within the existing chimney except for its extensions out the ashpit door opening.

As shown in FIGS. 3 and 4, in its preferred form, instead of a cluster of spaced pipes, or conduits, of circular cross section, the sections 83, 84 and 85, corresponding to sections 69, 71 and 72, are of hollow right angular configuration to each form either a vertical, upward flow compartment 86 or a vertical downward flow compartment 87. The right angular sections are joined by releasable latches 88 to jointly define a hollow rectangle 89 so that an outer smoke passage 56 is formed and an inner smoke passage 58 is also formed. The right angular sections are coupled end to end to each other in the same manner as are the sections 69, 71 and 72.

Figure 6:
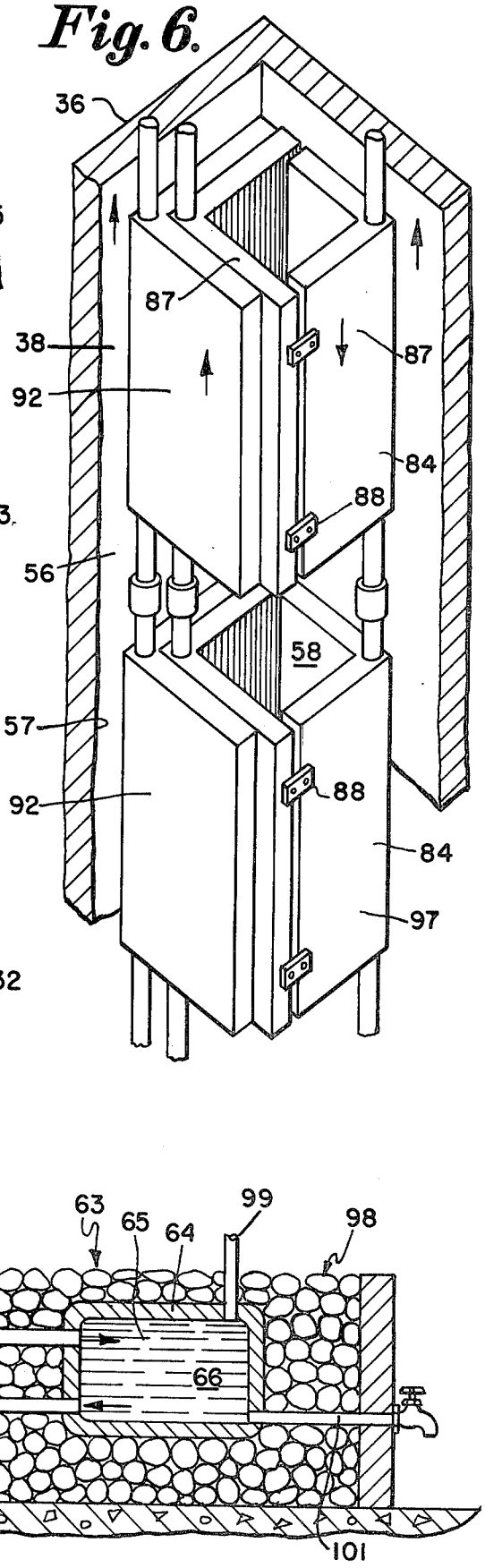
FIG. 6 is a view similar to FIG. 5 showing effluent and influent conduits both in a thin walled jacket of right angular cross section.

As shown in FIG. 4 one of the advantages of the preferred right angular configuration is that it can be used singly, with a suitable vertical partition 91 to divide it into an upward flow and a downward flow compartment. It thus will fit within a small 8"×6" chimney with minimum interference with draft. Such a partitioned right angular section can be opposed to another section to form three upflow and one down-flow, return conduits. For a larger area chimney, as shown in FIG. 6, additional right angular sections such as 92, identical with sections 83, 84 or 85 can be nested outside another section to increase the heat exchange capacity.

As shown in FIG. 5 instead of a cluster of separate conduits, or a single, or dual, right angular conduit, the sections may be of hollow, annular rectangular cross section as at 93 and 94 to define an inner smoke passage 58 and an outer smoke passage 56. One or more vertical interior partitions such as at 95 and 96 may be used to form upward flow and downward flow conduits therewithin.

In all of the heat exchangers depicted the exterior walls 97 thereof are at a spaced distance from the inner wall 57 of the chimney. The closed loop system of the invention, wholly within the existing chimney except for the horizontal sections can be tied in with the rock storage means 98 of solar heat systems as shown in FIG. 5 to supplement the heat derived therefrom or the storage tank 64 can be connected to the tap water system of the house by pipes 99 and 101.

The heating fluid in the system could be air rather than water, to avoid danger of leakage or freezing but water provides a more permanent heat storage and a more extended heat dissemination so that it is preferred. The thin sheet metal walls of the right angular and rectangular cross section embodiments of the invention, will yield and flex in the event of a prolonged cold period to avoid fracture by freezing and intermittent circulation by the pump at spaced intervals, regardless of furnace operation also avoids freeze up but antifreeze is the preferred solution to the possible freeze up of the liquid within the chimney.

In each embodiment of the invention suitable pressure relief valves and control valves V, of well known, commercially available, type are provided to automatically shut off the supply of water, or shut off the boiler in case of liquid leakage, undue pressure, undue temperature, or other eventualities.

Upon installation, a $CO^2$ draft reading device is mounted on the chimney to determine whether a draft inducer 46 will be necessary or whether draft will be adequate and efficient after a waste heat collector of the invention is installed.

I claim:

1. In combination with a house heating system having a furnace, a brick chimney, a smoke flue connecting the furnace to the interior of the chimney, said chimney being free of apertures except a top opening, a smoke flue opening and an ash pit opening, an elongated heat exchanger comprising a closed, fluid-circulating system, said system including at least two vertical fluid carrying conduits extending along the interior of said chimney from proximate the level of said ash-pit opening, and at least two horizontal lower extensions thereof extending out of said ash-pit opening to a heat storage and dissemination means within said house, said conduits within said chimney being spaced from the inside walls thereof to form an annular smoke passage therebetween, and one said conduit extension including an electric motorized pump for circulating said fluid in a closed, sealed path upwardly in at least one said conduit and downwardly in at least one other said conduit.

2. A combination as specified in claim 1, plus an electric motor driven blower in said smoke flue for inducing artificial draft in said brick chimney to compensate for any loss of draft due to the presence of said heat exchanger within said chimney.

3. A combination as specified in claim 1 wherein:

said vertical, fluid circulating conduits, within said chimney, are formed of sections, coupled end to end to each other by threaded union couplings, each section being of dimensions and weight suitable for individual lowering down said chimney from said top opening.

4. A combination as specified in claim 1 wherein:

said vertical fluid circulating conduits within said chimney are formed of sections, coupled end to end to each other and each section comprises a cluster of elongated, parallel thin walled pipes of corrosion-resistant metal, said pipes being joined to each other by spider means into an integral unit.

5. A combination as specified in claim 4 wherein:

each said pipe is of stainless steel and includes a plurality of integral longitudinally extending exterior fins, alternated with grooves.

6. A combination as specified in claim 1 wherein:

said vertical, fluid-circulating conduits within said chimney are formed of thin-walled corrosion-resistant sheet metal; are of hollow rectangular, annular cross section, to form a smoke flow passage therewithin to supplement the said annular smoke flow passage therearound and are formed of sections coupled end to end to each other.

7. A combination as specified in claim 1 wherein:

said vertical fluid circulting conduits within said chimney are each formed of thin-walled, corrosion-resistant sheet metal; are of hollow right angular cross section, are formed in sections coupled end to end to each other and juxtaposed said sections define a conduit of rectangular cross section.

8. A combination as specified in claim 1 wherein:

said vertical fluid circulating conduits within said chimney are formed in sections threadedly coupled end to end to each other and to said extensions, each said section being of right angular configuration, whereby each juxtaposed pair may be joined to form an annular, conduit of rectangular cross section and additional such sections may be nested thereon for greater heat exchange in chimneys of large area of cross section.

9. The method of obtaining additional heat from an existing house heating system of the type having a brick chimney, a furnace, a smoke flue connecting the furnace to the chimney, an ash pit door opening in the chimney and an elongated heat exchanger fitting centrally of the space within the chimney which comprises the steps of:

forming the heat exchanger of thin, corrosion-resistant, sheet metal in hollow, elongated, liquid carrying sections;

raising said sections to the roof of said house and lowering each section down the interior of the chimney to the level of the ash pit door while successively, threadedly coupling said sections end-to-end to each other;

connecting the lowermost said section threadedly to extension liquid conduits leading out of said ash pit door to heat storage and dissemination means to form a closed, liquid carrying loop and then pumping liquid up one portion of said sections and down another portion thereof to absorb waste heat from said chimney and transfer it into said house through said system.

10. In a house heating system of the type having a furnace, a chimney, a smoke flue opening into the chimney connecting the furnace into the interior of the chimney, and an ash pit door opening in said chimney, the combination of:

an elongated heat exchanger of predetermined height mounted in, and extending up, the central portion of the interior of said chimney; said heat exchanger comprising at least two liquid carrying conduits having exterior walls spaced from the interior wall of said chimney to form an annular passage therebetween for hot combustion gases;

said heat exchanger being formed of a plurality of elongated sections, removably connected to each other at sealed coupling joints, each said section being adapted to be lifted to the roof of said house, and lowered into the interior of said chimney in successive end to end lengths;

mounting means for supporting said heat exchanger within said chimney and horizontal liquid conduit extension means connected to said liquid-carrying conduits, and leading out of one of said chimney openings, for circulating liquid through said exchanger in a closed loop system and transferring heat therefrom to the interior of said house, whereby no structural renovation of said house is required to install said heat exchanger.

11. A house heating systme, as specified in claim 9, wherein:

said heat exchanger comprises a plurality of individual elongated sections, joined end to end, and each section is of hollow, rectangular, annular configuration jointly defining said liquid conduits and having a central, inner, passage for said hot combustion gases.

12. A house heating system as specified in claim 9 wherein:

said liquid carrying conduits are formed in clusters of a plurality of thin-walled, corrosion-resistant, sheet metal pipes, said clusters being threadedly coupled end to end to each other for ready insertion down, or removal from, said chimney and each said pipe having outwardly projecting, integral, longitudinal ribs, or fins, separated by grooves.

* * * * *